US009762004B2

(12) United States Patent
Bower et al.

(10) Patent No.: US 9,762,004 B2
(45) Date of Patent: Sep. 12, 2017

(54) SHIELDED BATTERY RECEPTACLE

(71) Applicants: Nathaniel J. Bower, Doylestown, PA (US); Alex J. Sinton, Doylestown, PA (US); David P. Pora, Reigelsville, PA (US)

(72) Inventors: Nathaniel J. Bower, Doylestown, PA (US); Alex J. Sinton, Doylestown, PA (US); David P. Pora, Reigelsville, PA (US)

(73) Assignee: ROCAL CORPORATION, Warrington, PA (US)

( * ) Notice: Subject to any disclaimer, the term of this patent is extended or adjusted under 35 U.S.C. 154(b) by 15 days.

(21) Appl. No.: 14/223,498

(22) Filed: Mar. 24, 2014

(65) Prior Publication Data

US 2015/0270650 A1 Sep. 24, 2015

(51) Int. Cl.

*H01R 13/648* (2006.01)
*H01R 13/6599* (2011.01)
*H01R 13/405* (2006.01)

(52) U.S. Cl.

CPC ..... *H01R 13/6599* (2013.01); *H01R 13/405* (2013.01)

(58) Field of Classification Search

CPC .. H01R 13/73; H01R 13/6599; H01R 13/405; H01R 13/65802; H01R 13/741–13/748; H01R 23/00

USPC ..... 439/607, 607.01–607.59, 567, 86, 88, 439/874, 500; 429/121, 123, 181, 131, 429/141, 163, 167, 254; 361/818; 264/255, 272.11; 29/428, 469.5

See application file for complete search history.

(56) References Cited

U.S. PATENT DOCUMENTS 2,205,878 A * 6/1940 Eby ..... H01R 13/11 429/184
3,141,054 A * 7/1964 Francis ..... H01R 43/24 264/255
4,337,301 A * 6/1982 Rorer et al. ..... 429/179
4,596,670 A * 6/1986 Liu ..... 252/511
4,678,260 A 7/1987 Gallusser
4,684,190 A * 8/1987 Clark ..... H01R 13/5219 439/277
5,326,186 A * 7/1994 Nyberg ..... B64G 1/641 403/325
5,436,803 A * 7/1995 Annis et al. ..... 361/818
5,725,387 A * 3/1998 O'Sullivan et al. ..... 439/98
5,958,303 A * 9/1999 Narkis et al. ..... 252/511
6,157,548 A * 12/2000 Collins ..... H01R 13/6599 174/377
6,305,985 B1 * 10/2001 Akiha ..... H01R 13/6599 428/411.1
6,375,863 B1 * 4/2002 Tachikawa et al. ..... 252/299.01
6,455,189 B1 * 9/2002 Nadeau ..... H01M 2/0237 429/121
6,457,917 B1 * 10/2002 Nomura et al. ..... 428/311.51
6,821,160 B2 * 11/2004 Fink et al. ..... 439/701

(Continued)

*Primary Examiner* — Tho D Ta
*Assistant Examiner* — Milagros Jeancharles
(74) *Attorney, Agent, or Firm* — Cusick IP, PLLC; Clinton J. Cusick, Esq.

(57) ABSTRACT

A shielded receptacle provides faraday shielding across conductive elements of the receptacle; a method of molding conductive materials into a shielded receptacle, and a method of molding nonconductive materials onto a conductive shield are disclosed.

13 Claims, 12 Drawing Sheets

(56) References Cited

U.S. PATENT DOCUMENTS

| | | | | |
|---|---|---|---|---|
| 6,896,828 | B2 * | 5/2005 | Fox | C08K 7/06 252/512 |
| 6,946,217 | B2 * | 9/2005 | Singer et al. | 429/65 |
| 7,083,471 | B2 * | 8/2006 | Hayashi | H01R 13/5221 439/159 |
| 7,351,098 | B2 | 4/2008 | Gladd et al. | |
| 7,575,476 | B2 * | 8/2009 | Tyler | H01R 13/65802 439/101 |
| 8,528,205 | B2 * | 9/2013 | Hughes | H01R 31/08 164/303 |
| 2005/0042922 | A1 | 2/2005 | Haller et al. | |
| 2006/0086520 | A1 * | 4/2006 | Romano | 174/35 MS |
| 2007/0212936 | A1 * | 9/2007 | Eckel | H01R 24/38 439/578 |
| 2009/0264020 | A1 * | 10/2009 | Xue | H01R 13/5045 439/660 |
| 2010/0041257 | A1 * | 2/2010 | Beck | H01R 13/627 439/108 |
| 2012/0030944 | A1 | 2/2012 | Hughes et al. | |
| 2012/0100414 | A1 | 4/2012 | Sonta | |
| 2013/0135841 | A1 | 5/2013 | Pavlovic et al. | |
| 2014/0287631 | A1 * | 9/2014 | Tashiro | H01R 13/521 439/733.1 |

* cited by examiner

FIG. 2A
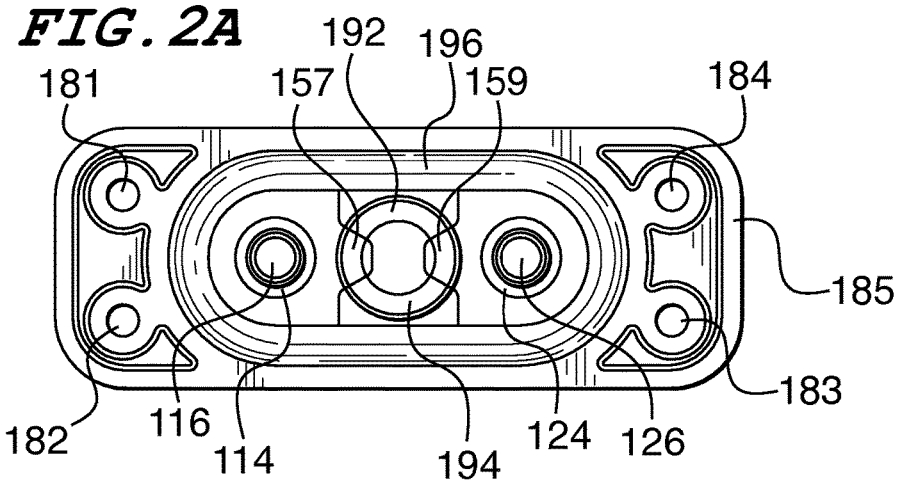
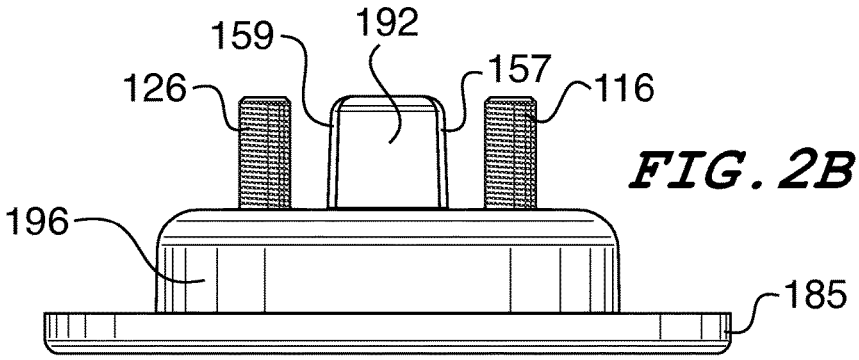
FIG. 2B
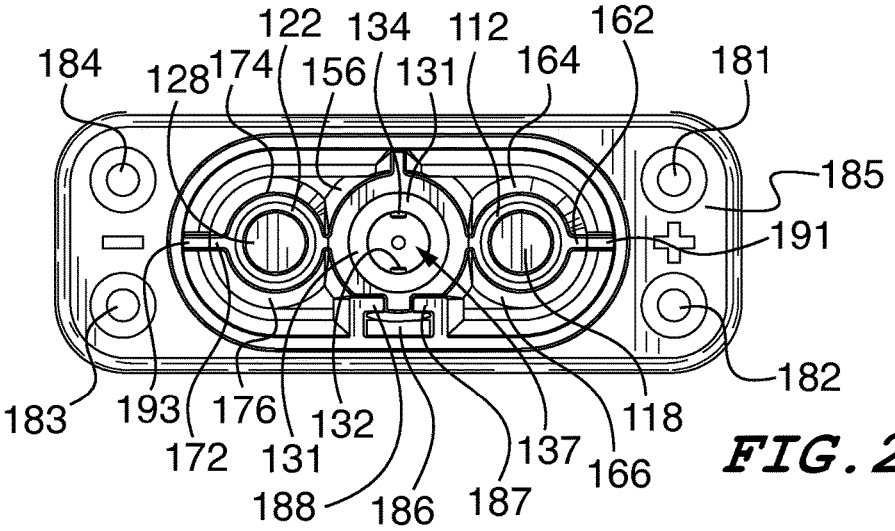
FIG. 2C

FIG. 9C
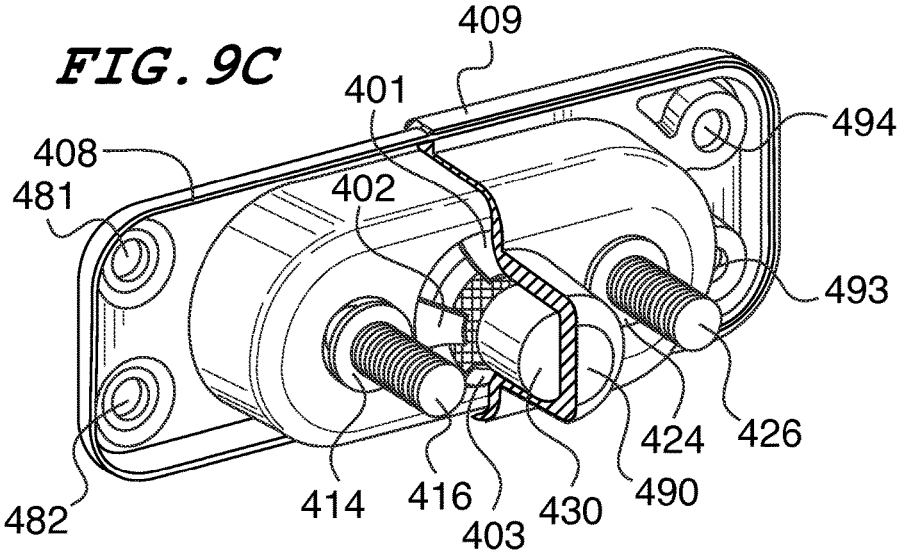
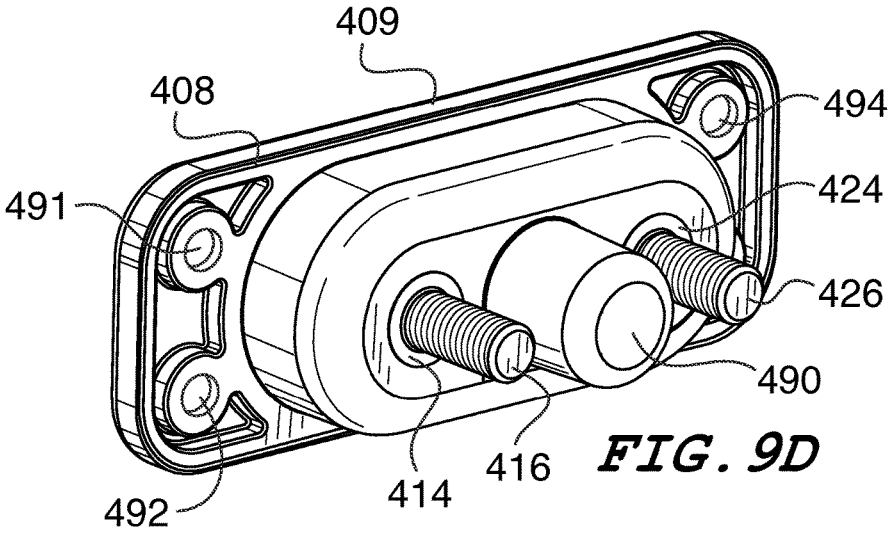
FIG. 9D

SHIELDED BATTERY RECEPTACLE

BACKGROUND OF THE INVENTION

Field of the Invention

The present general inventive concept is directed to an improved device for connecting a power source and shielding a power source from radiation.

Description of the Related Art

Portable power sources are widely used in airplanes, cell phone towers and other remote and mobile applications. Power sources such as batteries can be contained in battery boxes or battery cans. These battery boxes can contain sensing equipment to determine the available voltage, the temperature of the battery and other useful information for determining the status of the power source. These sensing devices are typically contained within the battery box, and it is desirable to shield the contents of the battery box from electromagnetic interference (emi). A metal container serves as a Faraday cage and shields the contents from emi. Vulnerabilities to the shielding capabilities of a Faraday cage include openings, namely any opening that is larger than the wavelength of the radiation to be blocked. Additionally, breaks in the conductive material surrounding the item to be protected do not provide shielding. The connection means to supply power from the power source to its desired application cannot be connected to a conductive metal container without creating a short circuit or draining the power source. Use of a plastic or non-conductive receptacle avoids a short circuit across the terminals but similarly does not provide shielding from emi. Thus, the connection means of the power source or battery provides an interval of non-conductivity which presents a discontinuity of emi shielding. Typical receptacles are several inches wide and provides an interval large enough for a wide range of electromagnetic radiation to pass. Through this interval, emi can enter the battery box and can affect or disrupt the devices or electronics inside. In mission critical power supplies such as aircraft applications or remote hosting backup power sources or cell phone towers where downtime is deleterious, power supplies and associated diagnostics need to be protected from emi.

What is needed is a receptacle for connection to a power source that provides shielding from electromagnetic interference.

SUMMARY OF THE INVENTION

It is an aspect of the present invention to provide a shielded power connection receptacle that connects a power source such as a battery and provides increased shielding from electromagnetic interference.

The above aspects can be obtained by combining an insulating insert with a conductive surround to create a shielded receptacle. In another embodiment, a conductive shield can be coated with a nonconductive layer to create a shielded receptacle.

A shielded receptacle comprising a first contact, a second contact, and a socket disposed within an insert where said insert is disposed within a surround, and the surround is conductive is disclosed. In another embodiment, a shielded receptacle comprises a conductive shield, a first conductive pin, a second conductive pin, and a socket is retained by the conductive shield, and a nonconductive coating is applied to retain the elements and form a shielded receptacle.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 2A presents a rear view of a receptacle in an embodiment of the invention.

FIG. 2B presents a top view of a receptacle in an embodiment of the invention.

FIG. 2C presents a front view of a receptacle in an embodiment of the invention.

FIG. 9C presents a partial cutaway rear view of a receptacle in an embodiment of the invention.

FIG. 9D presents a perspective view of a rear of a receptacle in an embodiment of the invention.

DESCRIPTION OF THE PREFERRED EMBODIMENTS

Figure 1:
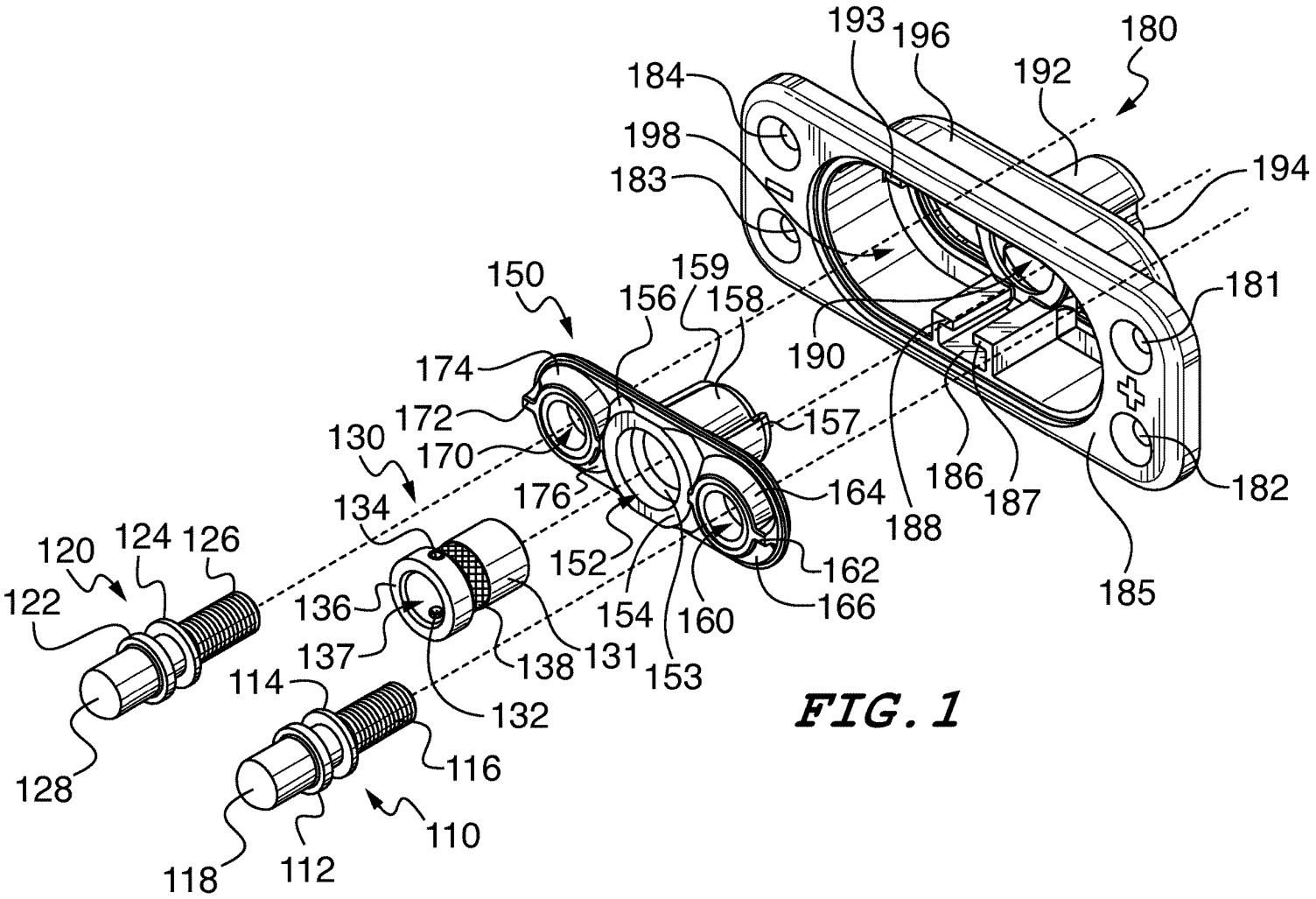
FIG. 1 presents an exploded view of a receptacle in an embodiment of the invention.

Reference will now be made in detail to the presently preferred embodiments of the invention, examples of which are illustrated in the accompanying drawings, wherein like reference numerals refer to like elements throughout.

The present inventive concept relates to a device for connecting a power source and providing significant shielding from emi, and a method for constructing said device. One embodiment of the invention utilizes conductive and non-conductive polymers that can be molded into a desired shape and that are suited to attach to metal conducting parts that conduct electricity from a power source so that the power source can be utilized as needed. A power source, such as a battery, can be connected to one side of the receptacle while a plug can be connected to the other side of the receptacle to provide for use in various applications. The manner of construction provides a cost effective and high performance device suitable for use in mission critical power supply applications.

FIG. 1 presents an exploded view of a receptacle in an embodiment of the invention. It is desired to provide a receptacle that contains both conducting and insulating aspects to provide for conductive connection to a power source, provide insulation around the conductive contacts to prevent shorting, and provide conducting materials in the balance of the receptacle to extend a faraday cage for electromagnetic shielding. FIG. 1 presents an arrangement by which a shielded receptacle can be constructed. This embodiment of the invention is constructed by molding an insulating insert onto the conductive metal parts to form an insert assembly. The insert assembly is then inserted into a conductive surround and the elements are joined to form a shielded receptacle. In an alternate embodiment, a conductive surround can be molded onto an insert assembly to form a shielded receptacle. FIG. 1 presents the elements of shielded receptacle in an embodiment in an exploded view.

First contact 110 is shown with first mating flange 112 and first attachment flange 114 and first connecting end 116. First contact end 118 is suited for electrical connection by friction fit. First contact 110 can be made of a conductive material that is structurally solid such as metal to provide a conductive contact. Silver, copper, and other conductive metals are suitable materials. In an embodiment, first contact 110 can be constructed of copper and coated with silver. Second contact 120 is shown with second mating flange 122 and second attachment flange 124 and second connecting end 126. Second contact end 128 is suited for electrical connection by friction fit. First contact 110 and second contact 120 can be identical or interchangeable and can be suited for connection to a plug, not shown. First contact end 118 and second contact end 128 can be of a nominal diameter of ⅜ of an inch in an embodiment. It has been found that spacing between first contact 110 and second contact 120 of 1.532 inches from center, provides sufficient distance to avoid arcing. Greater spacing leads to a larger receptacle and greater potential for emi interference. Smaller spacing between the contacts increases the potential for voltage leakage between contacts. In one embodiment suitable for attachment to a battery box, the receptacle is about 4.3 inches long, 1.625 inches wide, and 1.6 inches deep. Socket 130 is suited to retain a connection with a plug by insertion of a locking shaft, not shown. Socket 130 can be formed of a structural material such as metal. One suitable metal is stainless steel that provides corrosion resistance, and socket 130 can be composed of stainless steel, and in an embodiment, series 400 stainless steel, and 440 stainless steel has been found to be a suitable material. Socket 130 is shown with socket opening 137 surrounded by socket collar 136 and socket closed end 131. Disposed within socket collar 136 are first socket lock pin 132 and second socket lock pin 134. First socket lock pin 132 and second socket lock pin 134 are fixed and will interface with a groove on a locking shaft as shown in later figures. In an embodiment, first socket lock pin 132 and second socket lock pin 134 are disposed across the circular socket opening 137 and spaced 180 degrees apart. These two lock pins will interface with a locking shaft with two grooves also spaced 180 degrees apart. As a way to key the receptacle with a plug, first socket lock pin 132 and second socket lock pin 134 can be positioned in a different configuration such as, by example 225 degrees apart, and will interface with a locking shaft with two grooves that are also 225 degrees apart. In this way, a plug can be inserted, or prevented from insertion, to ensure the proper type of plug is used with the corresponding receptacle. Knurled section 138 mechanically locks and prevents rotation of socket 130 within insert 150. Grooves, ridges, or uneven surface can also provide mechanical resistance to prevent rotation of socket 130 within insert 150. Socket 130 can be inserted into socket opening 152 of insert 150. Additionally, insert 150 can be made of a nonconductive thermoplastic molded onto metal parts by injection molding of insert 150 around socket 130, first contact 110, and second contact 120. Additionally, insert 150 can be made of a thermosetting resin that is cured in a mold around socket 130, first contact 110, and second contact 120 to form a thermoset insert 150. One suitable thermoset material is diallyl phthalate. FIG. 1 shows the elements in an exploded view for clarity although molding insert 150 onto, for example, first contact 110, would prevent separation of separation contact 110 from insert 150. Insert 150 can also comprise a first annular retainer 160 to retain first contact 110 and a second annular retainer 170 to retain second contact 120. First annular retainer 160 can comprise first upper chamfer 164 and first lower chamfer 166. Second annular retainer 170 can comprise second upper chamfer 174 and second lower chamfer 176. Retainer first rib 162 extends outward from first annular retainer 160 and is suited for connection to surround first rib, not shown. Retainer second rib 172 extends outward from second annular retainer 170 and is suited for connection to surround second rib 193. Socket support chamfer 156 provides additional structural thickness around socket opening 152, and additional material thickness can be added as needed to provide stiffness or strength. Socket ring 154 provides a smooth surface and defines socket opening 152. Socket opening 152 comprises socket seat 153 which is restricted in circumference and interfaces with knurled section 138 to secure socket 130 against rotation. Insulator barrel 158 is shown protruding from insert 150 and has additional thickness on each side formed as first wing 157 and second wing 159. Insert 150 is preferably composed of a non-conductive material. Suitable nonconductive materials include plastic, or nonconductive thermoplastic polymers such as polyethylene, nylon, or other materials that are suited for molding, such as injection molding. Nonconductive materials as used herein are defined as having a surface resistivity greater than 10^12 ohms/sq. as determined by ASTM D257 for insulating materials and ASTM D4496 for moderately conductive materials.

Surround 180 is preferably composed of a conductive material. Conductive materials are herein defined as having surface resistivity of less than 10^12 ohms/sq. Suitable materials include thermoplastics comprising conductive elements such as metal flake or metal strands. One commercially available conductive material is LNP™ Faradex™ DS0036IP, a compound based on polycarbonate resin and containing stainless steel fibers. This material Faradex is available in a pellet form and can be heated and used to make parts in desired shapes by injection molding. Other suitable thermoplastics, and resins are suitable for making a conductive surround 180 within the scope of the invention. Polycarbonate resin can be used and acrylonitrile butadiene styrene (ABS) can be used, as well as other moldable thermoplastic materials. Moldable thermoplastic materials can be loaded with conductive additives such as carbon, stainless steel, or nickel where the conductive additive has been reduced in size to flake, particle, or fiber. The size of the conductive additive should be small enough to intersperse through the moldable material without affecting the shape of the molded part. Additionally, the conductive additive should be relatively continuous throughout the molded part. In an embodiment, stainless steel fibers make up about 1% of the volume of surround 180. Conductive additive in a range of at least 0.5% to 1% volume can provide sufficient conductivity to create a conductive material. Conductive additive stainless steel fiber of 0.8% or more combined with a polycarbonate resin can also provide a conductive material suitable for molding. The use of a conducting material for surround 180 will interface with the metal of a battery box and extend the coverage of the faraday cage created by the conductive metal box. One method for connecting insert 150 with surround 180 is to overmold surround 180 onto insert 150. In one method of production, an insert can be molded utilizing a nylon material with a melting temperature of about 600 degrees F. A surround can be molded of polycarbonate resin having a melting temperature range of 550 to 600 degrees F., in a range of 310 to 315 degrees F. Insert 150 can be formed around first contact 110, second contact 120, and socket 130 by injection molding to create an insert assembly. Herein, an insert assembly comprises elements 110, 120, 130, and 150. When surround 180 is molded onto insert 150 of an insert assembly, it can be accomplished at the lower temperature of about 550 degrees F. and does not affect the structure of insert 150 or the insert assembly. The result is an insert 150 and a surround 180 that are molded together to form a continuous structure comprising a shielded receptacle. In another method, the insert 150 is molded onto metal parts to form an insert assembly, a surround 180 can be molded separately, and the surround 180 can then be joined to insert 150 by ultrasonic welding to create a shielded receptacle.

Surround 180 comprises a substantially flat periphery, faceplate 185, and a rear protrusion, shoulder 196 which is the rear surface corresponding to central cavity 198. Shoulder 196 is substantially convex. Central cavity 198 can comprise a key hollow 186 and a first key rib 187 and a second key rib 188 to determine proper orientation of a plug, not shown. Key rib 187, for instance provides central cavity 198 with a perimeter that is not symmetrical and prevents insertion of a plug, not shown, upside down, for example, and prevents connection of contacts in an unintended configuration. Shroud opening 190 is shown centrally disposed within central cavity 198. Shroud top 192 and shroud bottom 194 protrude from shoulder 196 and are configured to receive insulator barrel 158 when inserted into shroud opening 190. First attachment opening 181 is shown disposed in faceplate 185 and is suitable to receive a fastener, including a conductive fastener, not shown. First attachment opening 181 can be beveled so that a fastener can be recessed. Second attachment opening 182, third attachment opening 183, and fourth attachment opening 184 are shown also disposed in faceplate 185, and can also be beveled for recessed placement of a fastener, not shown. Central cavity 198 can be oval shaped and gives rise to shoulder 196 having a corresponding shape protruding from the rear surface of surround 180.

In one method of assembly, metal parts first contact 110, second contact 120, and socket 130 are placed in a mold and a polyamide 6 nylon with 35% glass reinforcement is heated to a temperature greater than 600 degrees F. and a pressure of about 12,000 psi and then is molded onto the metal parts to form insert 150 about the metal parts and create an insert assembly. The insert assembly can then be placed in another mold where a polycarbonate resin and 0.8% stainless steel fiber conductive additive are heated above 550 degrees F. and surround 180 is molded onto the insert assembly. Polycarbonate resin has a melting point range less than 600 degrees and insert 150 is well below the melting temperature range of polyamide 6 nylon and does not deform upon contact with polycarbonate resin at less than 600 degrees F.

Other materials can be utilized to create a shielded receptacle in an embodiment of the invention. Polyphenylene sulfide can be heated to a temperature greater than 600 degrees F. and injected under pressure of about 11000 psi to form a nonconductive insert 150 around and fixedly connect to first contact 110, second contact 120, and socket 130. The insert assembly can be fixedly attached to a surround 180 by ultrasonic welding.

In another method of assembly, insert 150 can be molded onto first contact 110, second contact 120, and socket 130 to create an insert assembly. Surround 180 can be separately molded of a polymer such as polycarbonate. The insert assembly can be inserted into surround 180 and the two pieces can be fixedly attached by ultrasonic welding. Surround 180 can be formed of a polymer such as polycarbonate resin containing between about 0.5% and 1% metal such as stainless steel fiber. Conductive additive such as stainless steel fiber when combined with polycarbonate resin will create a conductive material. Other conductive additives such as carbon, carbon powder, carbon nanotubes, nickel, or other conductive metals such as silver can be used. Metals that do not rust or corrode provide consistent results, including stainless steel and nickel. In an embodiment, a shielded receptacle can be constructed by positioning a first contact 110, a second contact 120, and a socket 130 into a mold and molding a nonconductive thermoplastic insert 150 onto the conductive elements 110, 120, 130 to form an insert assembly. The nonconductive thermoplastic can by a nylon, or nylon 6 heated to a temperature of at least 600 degrees F. and pressurized to at least 11,000 psi prior to injection molding to form insert 150. The insert assembly can be placed into a conductive surround 180 and permanently connected by ultrasonic welding. Insert 150 can also be composed of nonconductive thermoplastic polyphenylene sulfide heated to a temperature of at least 600 degrees F. and a pressure of at least 11,000 psi prior to molding insert 150. A surround can be made by providing a mold corresponding to the shape of surround 180 in FIG. 1, heating polycarbonate resin containing 0.5% conductive additive carbon fiber to 575 degrees F. and a pressure of 11000 psi and injection molding a conductive surround 180. In another method of production an insert assembly can be placed in a mold and polycarbonate resin with at least 0.5% conductive additive can be molded onto the insert assembly to form the shielded receptacle as shown in FIGS. 2A through 3B. In an alternate embodiment, insert 150 can be molded onto first contact 110 and second contact 120 omitting socket 130.

FIG. 2A presents a rear view of a receptacle of the invention as assembled, in an embodiment of the invention. Shoulder 196 is shown central to rear surface of faceplate 185. Shroud top 192 is shown connected to shroud bottom 194 and also to first wing 157 and second wing 159. First wing 157 serves to insulate against unwanted conduction from first connecting end 116. Second wing 159 serves to insulate against unwanted conduction from second connecting end 126. First attachment flange 114 is shown radially protruding about first connecting end 116 and prevents first connecting end 116 from moving into shoulder 196. Second attachment flange 124 is shown radially protruding about second connecting end 126 and prevents second connecting end 126 from moving into shoulder 196.

FIG. 2B presents a top view of a receptacle in an embodiment of the invention. Shoulder 196 is shown protruding from the rear of faceplate 185. First connecting end 116 is suited for connection to a power source, not shown, by means including threaded connection. Other means such as friction fit, insertion into a sleeve, or compression by a clamp, are contemplated within the scope of the invention. Threaded connection secured by an additional element such as a threaded nut can provide a secure connection. Second connecting end 126 is suited for attachment to a power source, not shown, and is shown configured for threaded connection. Shroud top 192 can be molded onto first wing 157 and second wing 159 in one method of manufacture. In another method of manufacture, first wing 157 and second wing 159 are molded as part of insert 150, not shown, and then inserted into surround 180 where first wing 157 and second wing 159 are adjacent to shroud top 192 and fixedly attached by ultrasonic welding.

FIG. 2C presents a front view of a receptacle in an embodiment of the invention. First contact end 118 is shown surrounded by first mating flange 112 which prevents movement of contact end 118 into shoulder 196. Second contact end 128 is shown surrounded by second mating flange 122 which also helps retain second contact end 128. First upper chamfer 164 and first lower chamfer 166 provide for additional thickness of the device to provide additional structural strength. Second upper chamfer 174 and second lower chamfer 176 provide for additional thickness of the device to provide additional structural strength. Surround first rib 191 is shown fused to retainer first rib 162 to provide continuous attachment of the elements shown as insert 150 and surround 180 of FIG. 1. Surround first rib 191 can be fixedly attached to retainer first rib 162 by ultrasonic welding, or by molding surround first rib 191 onto retainer first rib 162. Similarly, surround second rib 193 is shown fused to retainer second rib 172 to provide continuous attachment and can be fixedly attached by ultrasonic welding or by molding surround second rib 193 onto retainer second rib 172. Socket support chamfer 156 is shown and can provide additional thickness in an embodiment of the invention. Additional thickness through additional chamfers can be provided as needed for various applications. First socket lock pin 132 and second socket lock pin 134 are shown protruding into socket opening 137 to engage a locking shaft, not shown.

Figure 3A:
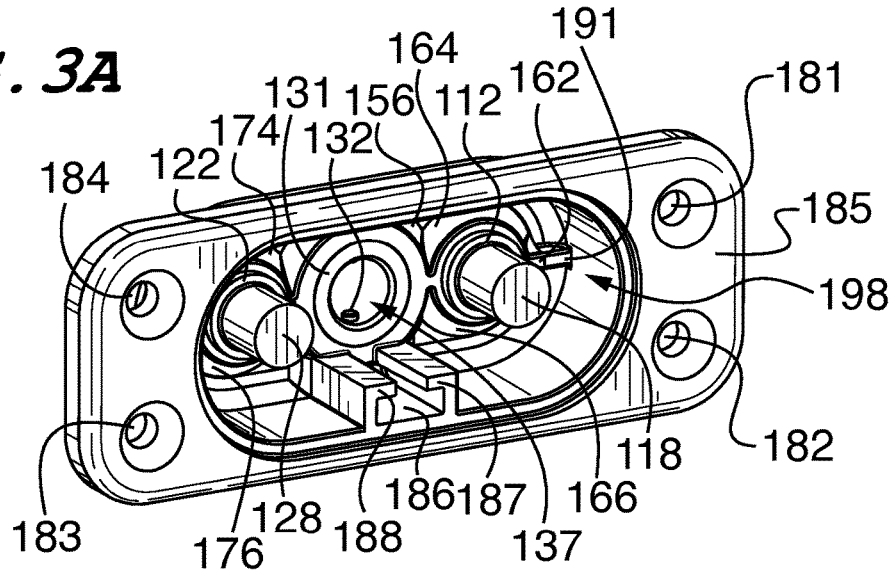
FIG. 3A presents a perspective view of a front of a receptacle in an embodiment of the invention.

FIG. 3A presents a perspective view of a front of a receptacle in an embodiment of the invention. First contact end 118 and second contact end 128 are shown within central cavity 198, extend outward, and are configured for connection with a plug, not shown. Central cavity 198 is suited for receiving a plug, not shown, and establishes electrical connection with the receptacle. Faceplate 185 is suited for physical attachment to a container such as a battery box, not shown, by way of first attachment opening 181, for example. First socket lock pin 132 is suited to guide rotation of a locking shaft not shown.

Figure 3B:
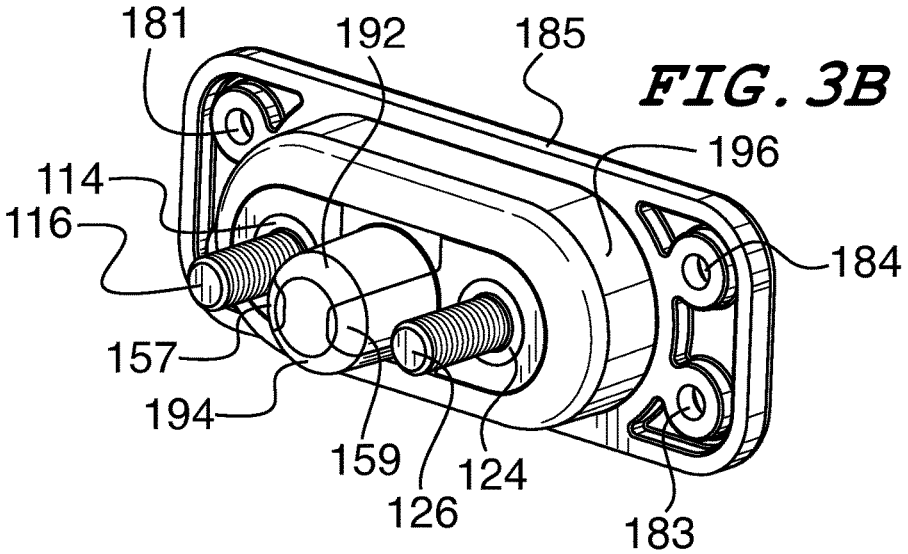
FIG. 3B presents a perspective view of a rear of a receptacle in an embodiment of the invention.

FIG. 3B presents a perspective view of a rear of a receptacle in an embodiment of the invention. First connecting end 116 is shown protruding away from shoulder 196 and is configured for connection with a power source. Second connecting end 126 is also shown directed away from the receptacle and is also configured for connection with a power source, such as a battery, not shown. Voltage, or emf, provided to first connecting end 116 will be conducted to first contact end 118 shown in FIG. 3A. Voltage, or emf, provided to second connecting end 126 will be conducted to second contact end 128 as shown in FIG. 3A. When fused, shroud top 192, shroud bottom 194, first wing 157, and second wing 159 combine to form a shroud configured as a unitary cylindrical protrusion, and this combination will be referred to in the following figures as a shroud. This can be accomplished by ultrasonic welding of the several elements together, or by injection molding of shroud top 192 and shroud bottom 194 adjacent to first wing 157 and second wing 159.

Figure 4A:
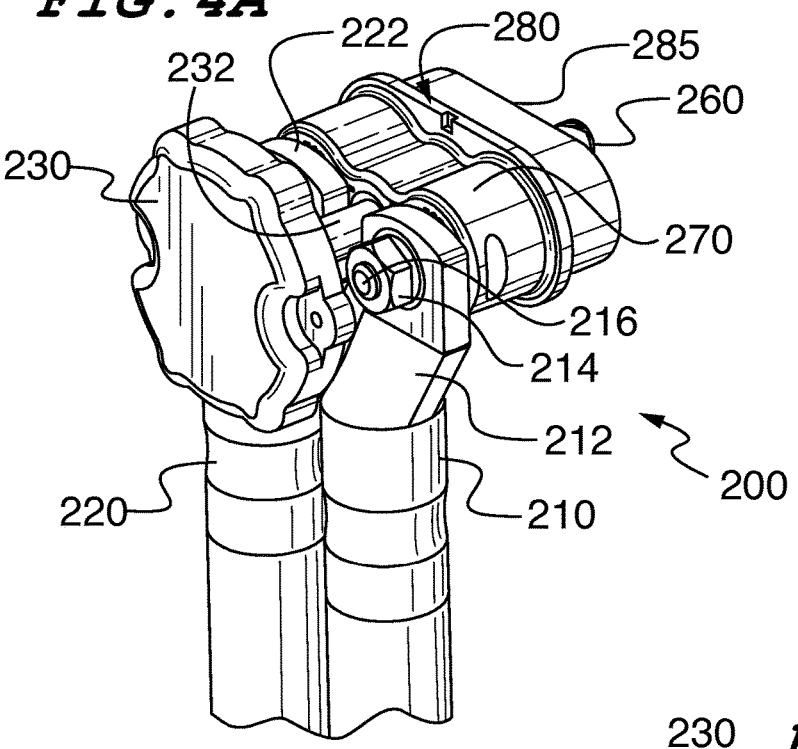
FIG. 4A presents a perspective view of a plug in an embodiment of the invention.

FIG. 4A presents a perspective view of a plug in an embodiment of the invention. The receptacle as shown in the preceding figures is configured to attach to a battery box and also to a power source. In order to provide electric power to an application, a conductive plug can be connected to the receptacle. One such suitable connection, plug 200 is shown in this figure. Handle 230 can be made of a plastic and connects to handle post 232 which can be made of a metal. Handle post 232 connects to locking shaft 260 so the handle 230, handle post 232, and locking shaft 260 turn in concert. First conduit 210 connects to first tab 212. First tab 212 is attached to first conductor end 216 by first retention nut 214. Second conduit 220 is connected to second tab 222, which can be attached to second conductor end, not shown, by second retention nut, not shown. Plug body 270 and plug surround 280 can be made of an insulating polymer. Suitable nonconductive polymers include thermoplastics. Locking shaft 260 is configured for insertion into socket opening 137 of FIG. 2C. Plug guide 285 is inserted into central cavity 198 of FIG. 3A.

Figure 4B:
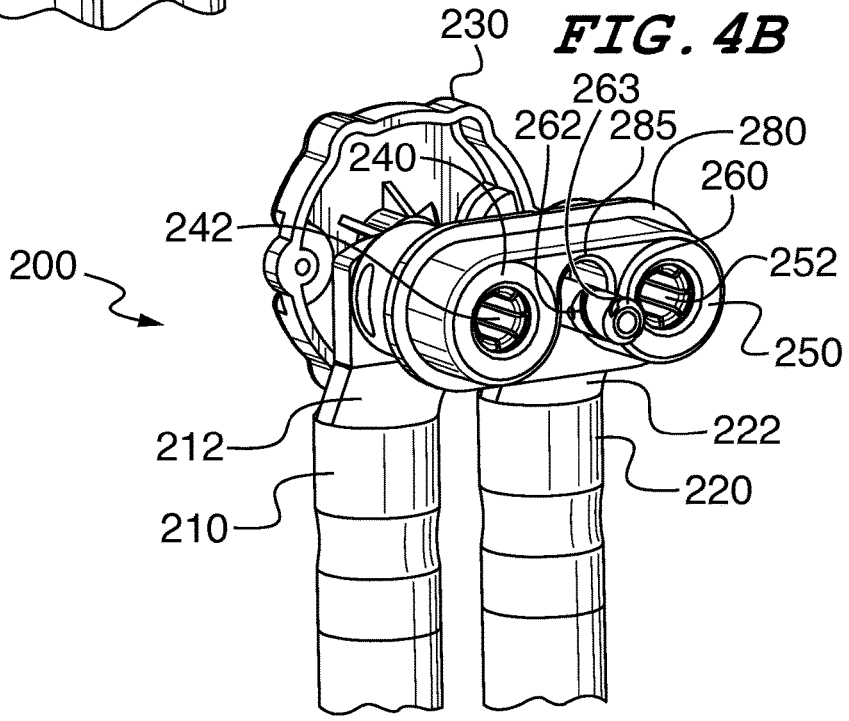
FIG. 4B presents a perspective view of a plug in an embodiment of the invention.

FIG. 4B presents another perspective view of a plug in an embodiment of the invention. First slotted sleeve 242 is retained by first socket cover 240. First slotted sleeve 242 is configured to connect with first contact end 118. First slotted sleeve 242 can comprise a plurality of metal members that can splay to accept first contact end 118. Second slotted sleeve 252 is retained by second socket cover 250. Second slotted sleeve 252 is configured to accept second contact end 128. Locking shaft 260 has at least one helical groove, first helical groove 262 on the exterior of locking shaft 260 to interface with first socket lock pin 132 disposed on the interior of socket 130 as shown in FIG. 2C. Locking shaft 260 can have a second helical groove 263 disposed on locking shaft 260 to interface with second socket lock pin 134 disposed on the interior of socket 130 as shown in FIG. 2C. When locking shaft 260 is inserted into socket 130 and turned by rotation of handle 230, first helical groove 262 provides a channel for one of first or second socket lock pins and draws locking shaft 260 into socket opening 137 of FIG. 2C. Second helical groove 263 can be parallel to helical groove 262, offset 180 degrees, and either groove 262 or 263 can engage either locking pin 132 or 134 to draw locking shaft 260 into socket opening 137. As discussed in relation to FIG. 2C, first socket lock pin 132 and second socket lock pin 134 can be positioned differently than 180 degrees apart. If, for instance first socket lock pin 132 and second socket lock pin 134 are positioned 225 degrees apart, then an embodiment where locking shaft 260 has first helical groove 262 and second helical groove 263 parallel to each other and separated by 225 degrees on locking shaft 260 would interface with the lock pins spaced similarly apart. In this way a plug can be keyed to connect, or prevented from connecting, to a particular receptacle that matches the application such as the voltage provided to the receptacle. In another embodiment, a receptacle can comprise a socket opening with locking pins offset by 210 degrees. In such an embodiment, the locking pins would match helical grooves offset by 210 degrees, but a plug comprising a locking shaft without this particular offset could not be inserted into such a receptacle. Plug guide 285 connects first socket cover 240 and second socket cover 250 and determines the orientation for insertion, opposite key hollow 186 of FIG. 3A.

Figure 5:
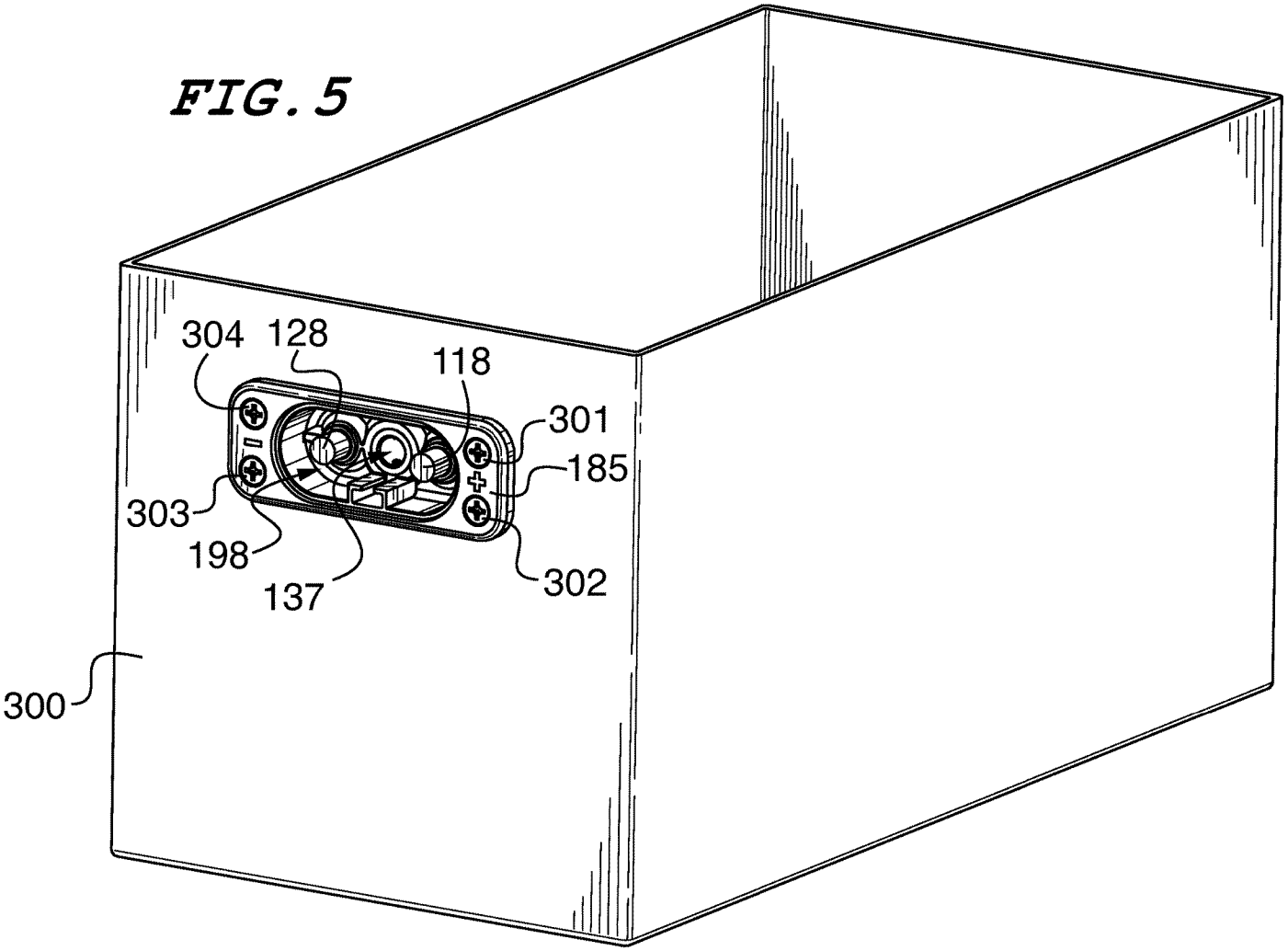
FIG. 5 presents a perspective view of a receptacle attached to a battery box in an embodiment of the invention.

FIG. 5 presents a perspective view of the front of a receptacle attached to a battery box in an embodiment of the invention. First box fastener 301 can be a metal fastener or a conductive fastener and can be used to retain the receptacle to a container such as battery box 300. Additional fasteners can be employed for secured attachment such as second box fastener 302, third box fastener 303, and fourth box fastener 304. The use of metal fasteners or conductive fasteners completes conductive connection of a shielded receptacle to battery box 300 to provide electromagnetic shielding by completing a faraday cage about the conductive portions of the shielded receptacle. Socket opening 137 is configured to receive locking shaft 260 of FIG. 4B. First contact end 118 is conductively connected to first connecting end 116, and second contact end 128 is conductively connected to second connecting end 126 as shown in FIG. 1. Central cavity 198 is configured to receive first socket cover 240, second socket cover 250, and plug guide 285 as shown in FIG. 4B.

Figure 6:
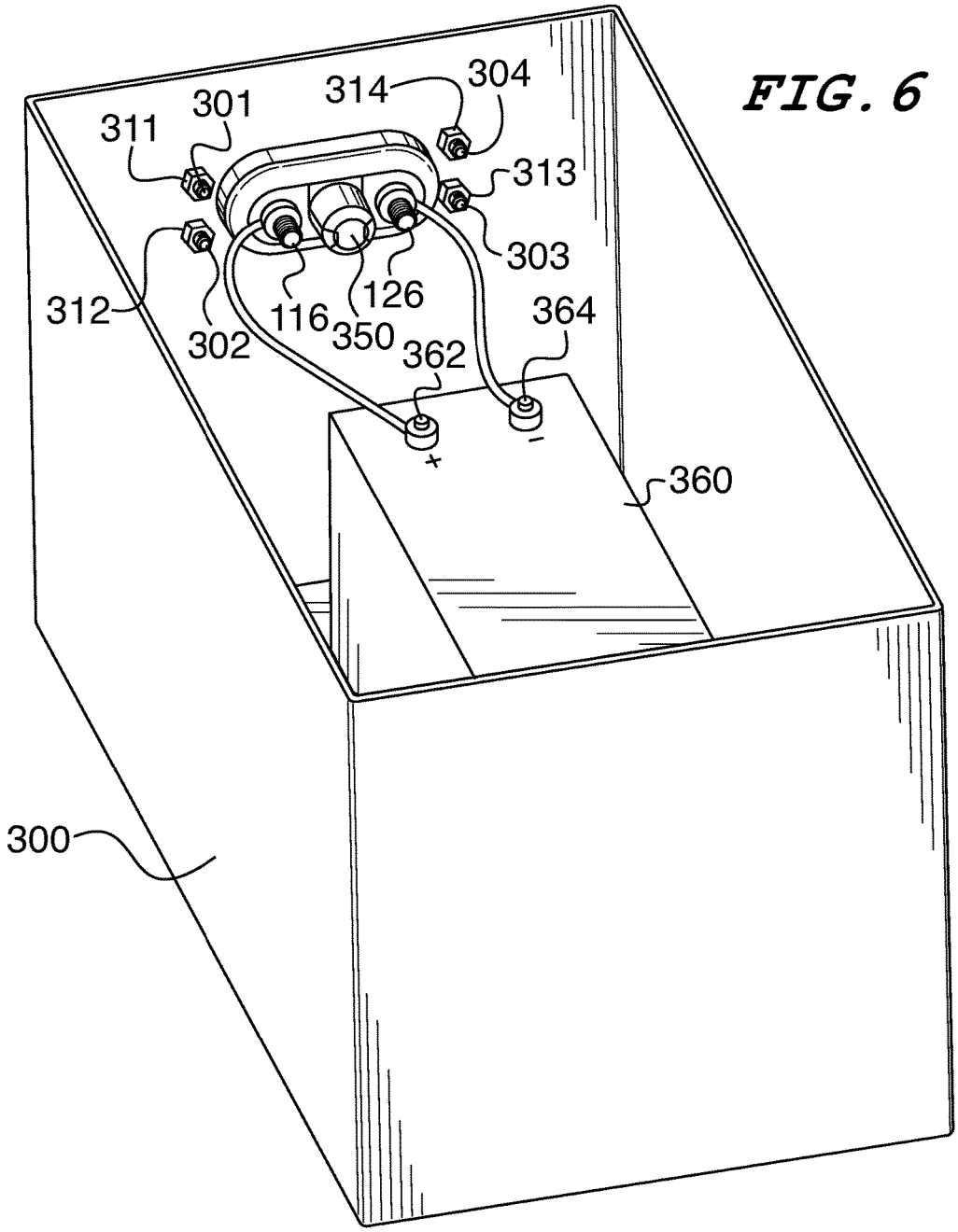
FIG. 6 presents a perspective view of a receptacle and a battery in a battery box in an embodiment of the invention.

FIG. 6 presents a perspective view of a rear of a receptacle attached to a battery in a battery box in an embodiment of the invention. First box fastener 301 is retained by first box nut 311 to secure the shielded receptacle to the battery box 300. Additional fasteners can be employed for secured attachment. Second box fastener 302 is retained by second box nut 312, third box fastener 303 is retained by third box nut 313, and a fourth box fastener 304 can be retained by fourth box nut 314 to secure a shielded receptacle to the battery box 300 in an embodiment of the invention. A power source, such as a battery 360 can be contained within the battery box 300. First terminal 362 can be connected to first connecting end 116 by conductive means such as a conventional insulated metal conductor. Second terminal 364 can be connected to second connecting end 126 by conductive means as known in the art. Shroud 350 is shown between first connecting end 116 and second connecting end 126 and contains nonconductive material to help prevent conduction between the two ends.

Figure 7A:
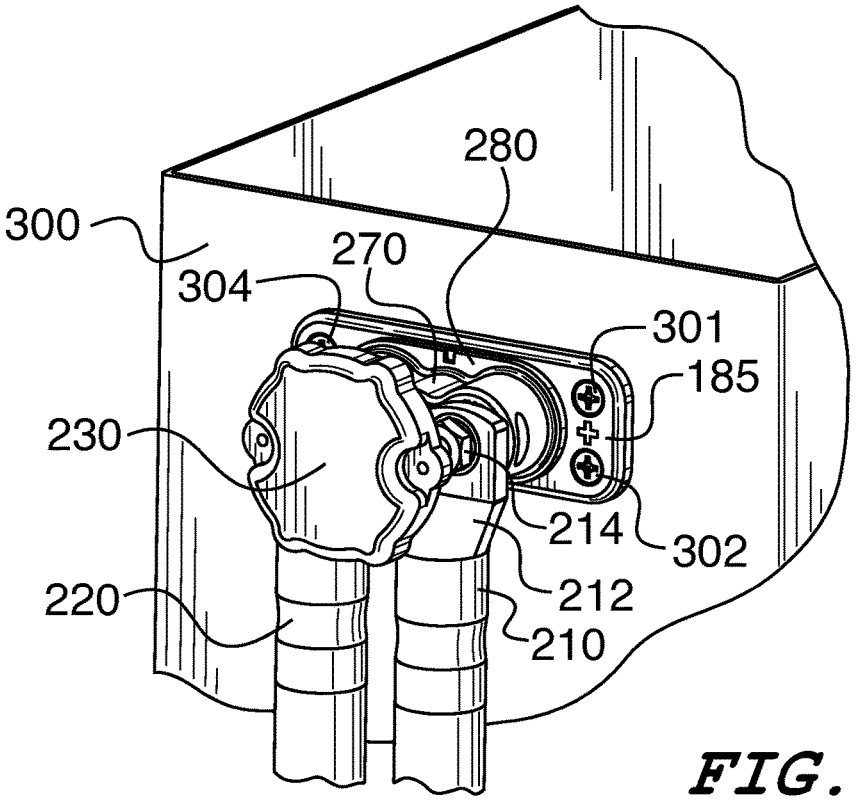
FIG. 7A presents a perspective view of a plug connected to a receptacle in an embodiment of the invention.

FIG. 7A presents a perspective view of a plug connected to a receptacle, in an embodiment of the invention. First socket cover 240, not shown, is inserted into receptacle central cavity 198, not shown, and neither is visible in this figure. Plug surround 280 covers central cavity 198, not shown, and provides a seal against debris or moisture. Plug body 270 is shown between face plate 185 and handle 230. Handle 230 has been rotated to draw elements of the plug into the receptacle to establish electrical connection.

Figure 7B:
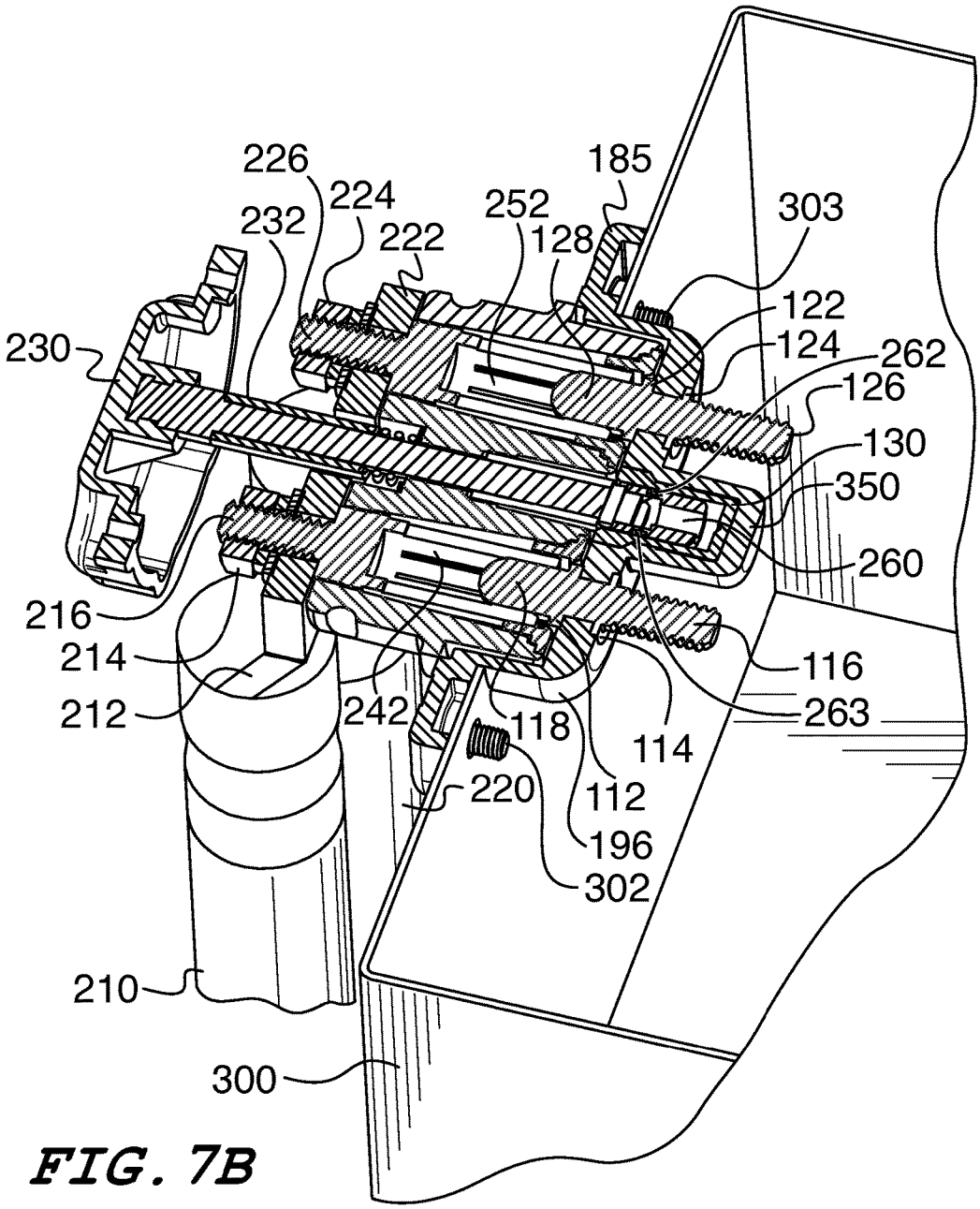
FIG. 7B presents a sectional view of a plug connected to a receptacle in an embodiment of the invention.

FIG. 7B presents a sectional view of a plug connected to a receptacle, in an embodiment of the invention. Handle 230 is connected to handle post 232 which is connected to locking shaft 260. First conductor end 216 contacts first slotted sleeve 242 which contacts first contact end 118 and provides for electrical conduction from first connecting end 116 through to first conduit 210. First tab 212 is connected to first conductor end 216 and retained by first retention nut 214. Second conductor end 226 contacts second slotted sleeve 252 which contacts second contact end 128 and provides for electrical conduction from second connecting end 126 through to second conduit 220. Second tab 222 is connected second conductor end 226 and is retained by second retention nut 224. When a plug is inserted into a receptacle such as pictured here, electrical power supply is made available from inside of battery box 300 to conduits 210 and 220 to provide power as needed in various applications. Additionally, a battery can be recharged and emf can flow into the battery through a plug, as pictured. Physical connection is maintained by locking shaft 260 interfacing with socket 130. The use of conductive materials to form faceplate 185 and shoulder 196, and other parts of surround 180 as shown in FIG. 1 provides a shielded receptacle that can interface with a battery box to extend a faraday cage and extend the electromagnetic shielding across a majority of the surface of the shielded receptacle. Other materials and configurations will be apparent to one skilled in the art. Further, the operations described herein can be performed in any sensible order.

In another embodiment of the invention, a shielded receptacle can be formed by overmolding a nonconductive coating around a conductive metal insert. Whereas the embodiment described above provides EMI shielding by interspersing a conductive material throughout the surround, another embodiment provides a continuous conductive member within the surround. Outwardly, the appearance of the shielded receptacle can be similar to the receptacle in another embodiment of the invention and can possess the configuration details presented in FIGS. 3A and 3B, and the shielded receptacle can interface with a plug and a battery box as shown in FIGS. 4A through 7B. However, the manner of construction is different and will be detailed here.

Figure 8A:
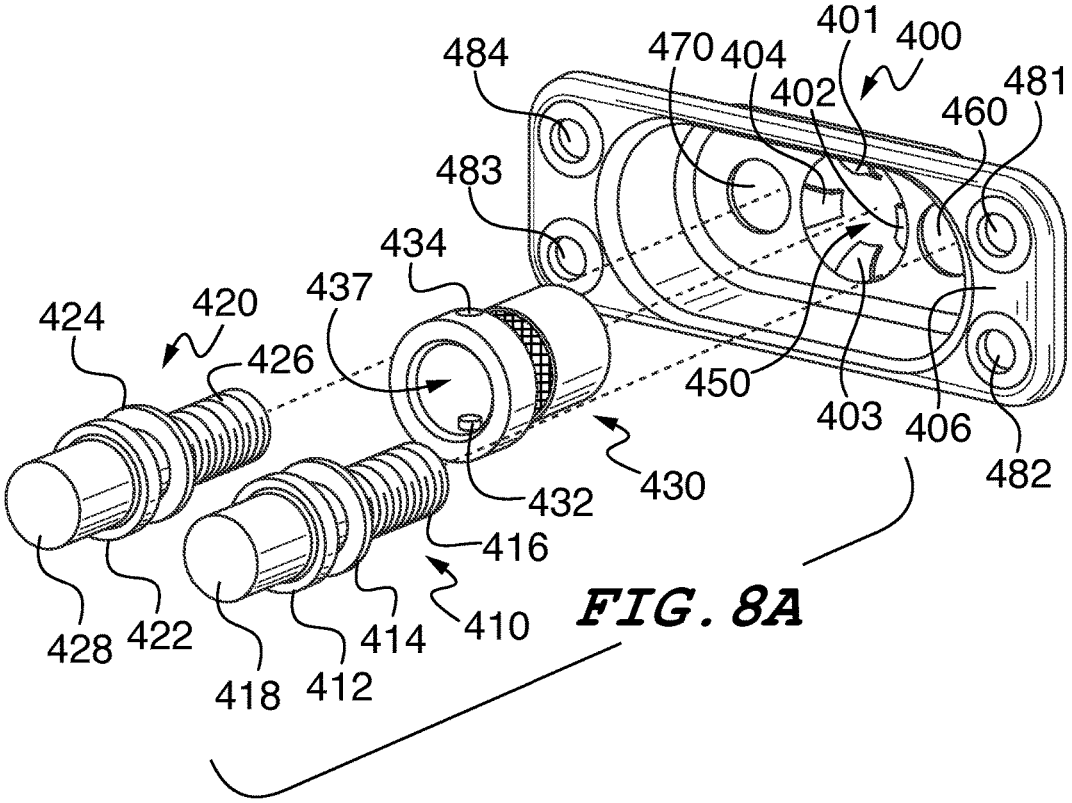
FIG. 8A presents an exploded view of a partially constructed receptacle in an embodiment of the invention.

FIG. 8A presents an exploded view of a front side of a partially formed shielded receptacle in an embodiment of the invention. This figure shows the alignment of first contact pin 410, second contact pin 420, and socket 430. Conductive shield 400 is preferably composed of a conductive material such as metal, and in an embodiment can be made of stainless steel and be formed by metal stamping by use of a tool and die into a desired shape including the shape of conductive shield 400. In an embodiment, conductive shield 400 can be formed of 300 series stainless steel. Conductive shield 400 comprises several openings to facilitate connection with other elements. First clearance hole 460 can accommodate first contact pin 410. Second clearance hole 470 can accommodate second contact pin 420. First contact pin 410 can be the same as first contact 110 of FIG. 1 and second contact pin 420 can be the same as second contact 120 of FIG. 1, but both are named and numbered differently for clarity. First contact pin 410 can be interchangeable with second contact pin 420. Splayed opening 450 can accommodate socket 430. Conductive shield 400 can comprise first attachment opening 481, second attachment opening 482, third attachment opening 483, fourth attachment opening 484, and shield face 406. First contact pin 410 can comprise first mating flange 412, first attachment flange 414, first connecting end 116 and first contact end 418. Second contact pin 420 can comprise second mating flange 422, second attachment flange 424, second connecting end 426 and second contact end 428. First contact pin 410 and second contact pin 420 can be made of metal or a combination of metals such as copper coated with silver. Socket 430 can comprise socket opening 437, first socket lock pin 432, and second socket lock pin 434. Socket 430 can be formed of metal such as stainless steel or 400 series stainless steel. In an embodiment, socket 430 is made of 440C series stainless steel. Splayed opening 450 can be centrally disposed within conductive shield 400 and can comprise a plurality of tabs. First tab 401, second tab 402, third tab 403 and fourth tab 404 are suited to receive and retain socket 430.

Figure 8B:
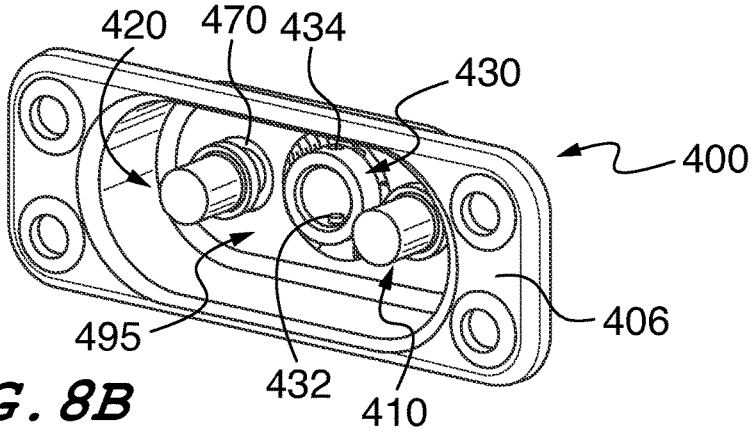
FIG. 8B presents a perspective view of a partially constructed receptacle in an embodiment of the invention.

FIG. 8B presents a perspective view of a front side of a shielded receptacle in an intermediate step of manufacture in an embodiment of the invention. Shield face 406 surrounds plug opening 495 which is suited for receiving a plug, for example as shown in FIGS. 4A and 4B. First contact pin 410, second contact pin 420, and socket 430 are shown positioned within conductive shield 400. At this stage of manufacture, the elements are configured for molding a nonconductive material onto the elements in FIG. 8B. Conductive shield 400 is shown with second contact pin 420 positioned within second clearance hole 470, first contact pin 410 positioned within first clearance hole 460, and socket 430 positioned within splayed opening 450. These elements can be held in place by clamping or designing a mold (not shown) with depressions, openings, and circumference that correspond to the geometry of the elements shown in FIG. 8B and holds the elements in place by friction fit or other means known in the art. While these elements are held stationary and spaced apart from each other within a mold, a thermoplastic or thermosetting resin can be molded onto the elements. First contact pin 410 does not contact conductive shield 400 and second contact pin 420 does not contact conductive shield 400 to prevent conductive contact or a short circuit between the contact pins. Suitable materials for molding include thermoplastics, high performance thermoplastics, and thermosetting resins. One suitable material for the nonconductive coating is polyphenylene sulfide (PPS) which can be heated to a temperature greater than 600 degrees F., for example 625 degrees F. and forced into the mold at 12,150 psi by a method such as injection molding to form a shielded receptacle with a nonconductive coating comprising a molded thermoplastic. Another suitable thermoplastic material for the nonconductive coating is 35% glass filled polyamide MXD6 nylon which can be injection molded at 600 degrees F. and a pressure of about 12,000 psi. Injection molding of a thermoplastic produces a shielded receptacle that is lightweight and rigid.

Figure 8C:
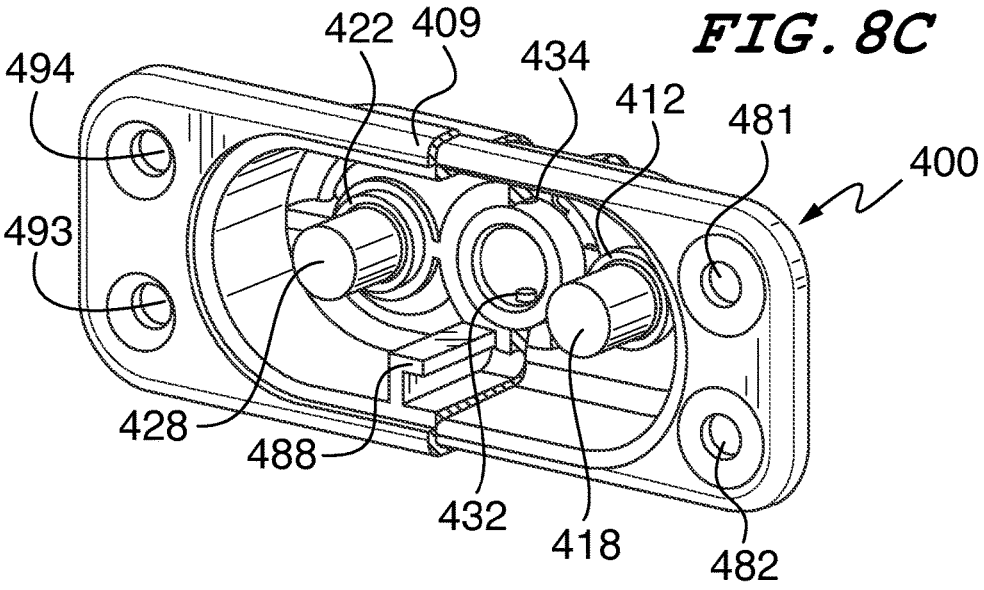
FIG. 8C presents a partial cutaway front view of a receptacle in an embodiment of the invention.

FIG. 8C presents a partial cutaway view of a front side of a shielded receptacle in an embodiment of the invention. For clarity, the receptacle is shown with only half of the nonconductive coating. The conductive shield 400 is shown with nonconductive coating 409. Nonconductive coating should have surface resistivity of at least 10^12 ohms/square and can be selected from known high temperature thermoplastics such as nylon or PPS or thermosetting resins such as diallyl phthalate. In an embodiment, 35% glass and mineral filled PPS can be used to form nonconductive coating 409. In one method of manufacture, conductive shield 400 is held within a mold that contacts inner circumference of fourth attachment opening 484 in FIG. 8B, and prevents application of nonconductive coating 409 to conductive shield 400 about the inner circumference of the opening. The result is exposed metal within fourth exposed opening 494. Third exposed opening 493 also presents exposed metal of conductive shield 400 that is not covered by nonconductive coating 409. Third exposed opening 493 can be beveled to recess a fastener head, not shown. When a conductive fastener, such as a metal fastener, not shown, is inserted into exposed opening 494, conductive connection is established to extend a faraday cage across the conductive shield 400 to another conductive element attached to the fastener.

Figure 8D:
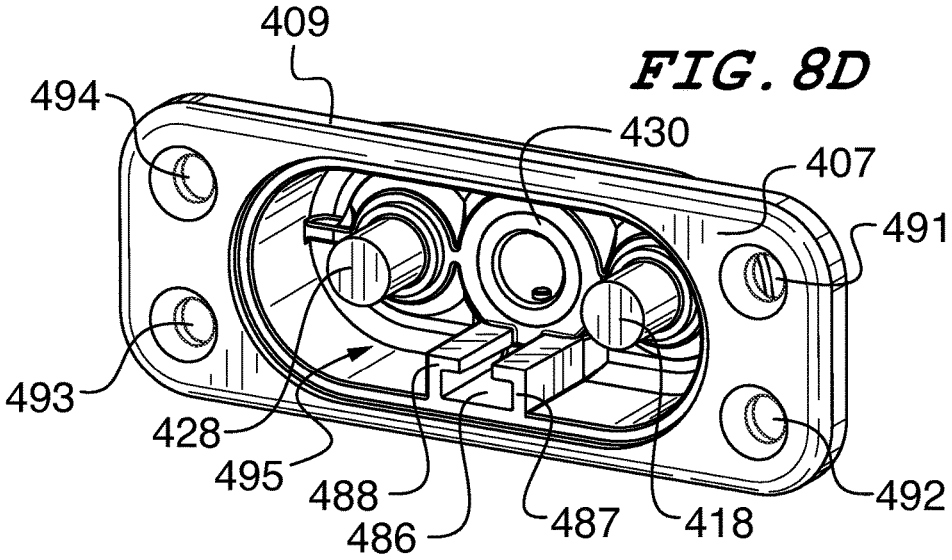
FIG. 8D presents a perspective view of a front of a receptacle in an embodiment of the invention.

FIG. 8D presents a perspective view of a front side of a shielded receptacle in an embodiment of the invention. Nonconductive coating 409 covers conductive shield, not shown. The embodiment shown in FIG. 8D contains a conductive shield that is in conductive contact with socket 430 and has exposed conductive area at first exposed opening 491, second exposed opening 492, third exposed opening 493, and fourth exposed opening 494. Plug opening 495 is configured to accept a plug such as shown in FIGS. 4A and 4B to establish electrical connection with the shielded receptacle. Key hollow 486 is shown between first key rib 487 and second key rib 488 which can present an obstacle to insertion of a plug, not shown, and can prevent inverted insertion of a plug into plug opening 495. This embodiment can be used with plug 200 shown in FIGS. 4A and 4B.

Figure 9A:
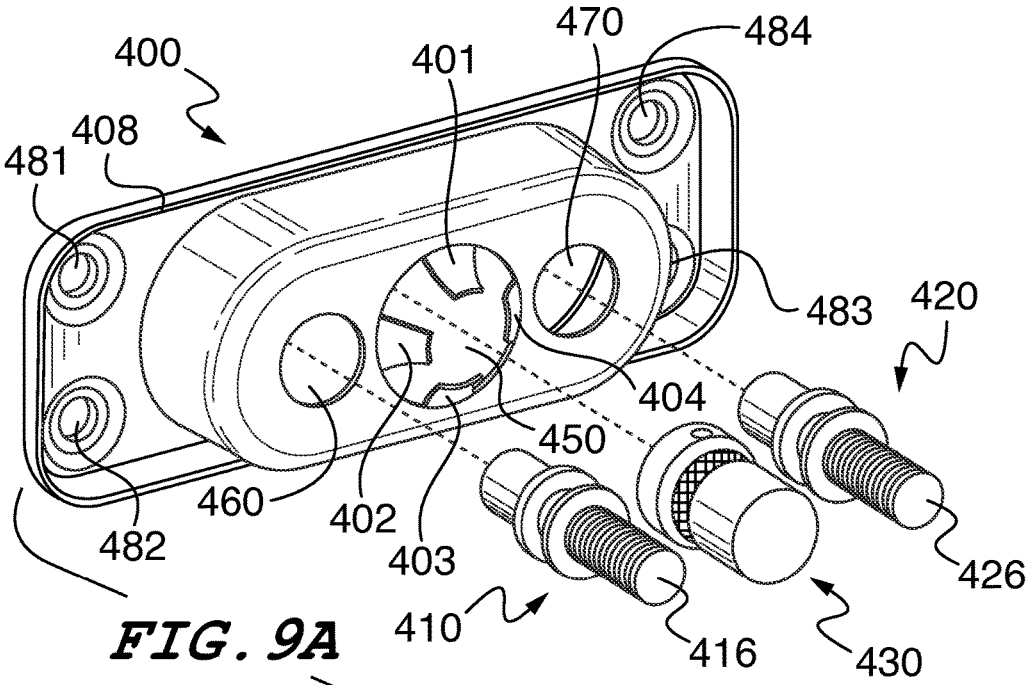
FIG. 9A presents an exploded view of a partially constructed receptacle in an embodiment of the invention.

FIGS. 9A through 9D present a rear view of the same subject matter shown in FIGS. 8A through 8D. FIG. 9A presents an exploded view of a rear side of a partially formed shielded receptacle in an embodiment of the invention. First contact pin 410, second contact pin 420 and socket 430 are shown positioned behind conductive shield 400 and aligned with the openings in which they can be inserted. Shield edge 408 extends around the rear perimeter of conductive shield 400. When placed in a mold, shield edge 408 can contact the mold so that conductive coating, not shown, does not cover shield edge 408.

Figure 9B:
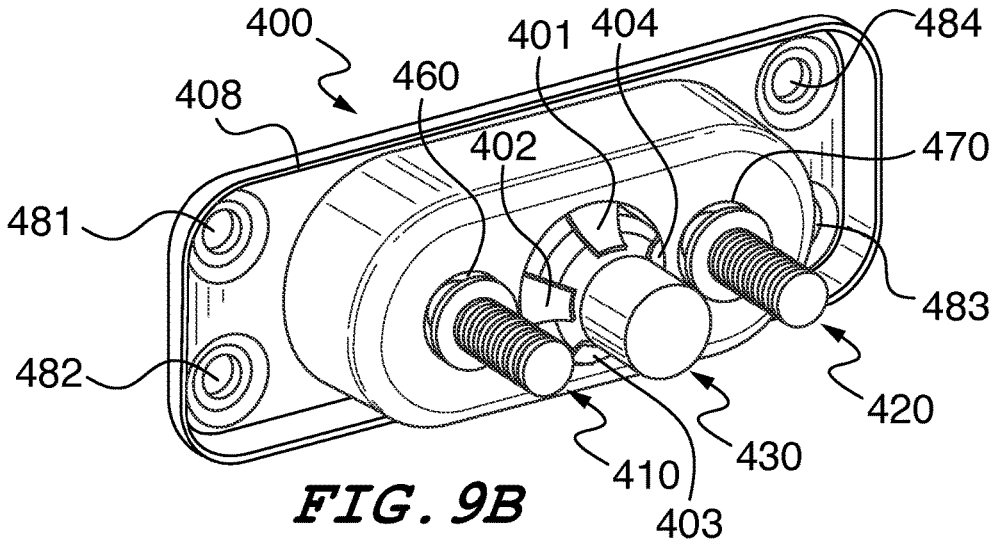
FIG. 9B presents a perspective view of a partially constructed receptacle in an embodiment of the invention.

FIG. 9B presents a perspective view of a rear side of a shielded receptacle in an intermediate step of manufacture in an embodiment of the invention. First contact pin 410 is shown within first clearance hole 460. Second contact pin 420 is shown within second clearance hole 470. Socket 430 is shown within splayed opening not numbered, and contacting first tab 401, second tab 402, third tab 403, and fourth tab 404.

FIG. 9C presents a partial cutaway view of a rear side of a shielded receptacle in an embodiment of the invention. Nonconductive coating 409 is partially shown about conductive shield 400. First tab 401 is shown contacting socket 430 and provides conductive contact. Additionally, second tab 402 and third tab 403 are shown contacting socket 430 and provide conductive contact. Shroud 490 is shown formed over socket 430 and is formed of nonconductive coating 409 to help prevent conduction between first connecting end 416 and second connecting end 426 when they are connected to emf or voltage. Shield edge 408 is not covered by nonconductive coating 409 and assists in making conductive connection with a battery box as shown in FIG. 5 to extend a faraday cage across the shielded receptacle.

FIG. 9D presents a perspective view of a rear side of a shielded receptacle in an embodiment of the invention. Shroud 490 is shown fully formed as non conductive coating 409 extends across the shielded receptacle. First exposed opening 491 and second exposed opening 492 are shown and suited for receiving a fastener such as a metal screw or a metal bolt that provides mechanical attachment and conductive contact to complete a faraday cage with another conductive object to which the fasteners are connected. Nonconductive coating 409 is noncontinuous and shield edge 408 is exposed to facilitate conductive contact with an element such as a battery box, and in this embodiment is configured for continuous conductive connection around the perimeter of the shielded receptacle.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A shielded power connection receptacle comprising:

a first conductive contact disposed within a nonconductive insert and a second conductive contact disposed within said nonconductive insert;

said first conductive contact comprises a first end protruding from a first side of said nonconductive insert and a second end protruding from a second side of said nonconductive insert;

said second conductive contact comprises a first end protruding from said first side of said nonconductive insert and a second end protruding from said second side of said nonconductive insert;

a socket comprising a socket closed end and a socket opening disposed in said nonconductive insert;

said nonconductive insert is permanently affixed to said first conductive contact and said second conductive contact and said socket;

said nonconductive insert is surrounded by a conductive surround comprising a nonconductive material and at least 0.5% conductive additive; and said conductive surround is permanently affixed to said insert to form at least one shared surface and provide electromagnetic shielding.

2. The shielded receptacle of claim 1 wherein:

said nonconductive material possesses a melting point below the melting point of said nonconductive insert.

3. The shielded receptacle of claim 1 further comprising:

a socket collar, and at least one socket lock pin disposed within an interior opening of said socket collar;

said first contact further comprises a first mating flange, a first attachment flange, a first connecting end, and a first contact end;

said second contact further comprises a second mating flange, a second attachment flange, a second connecting end, and a second contact end; and said insert surrounds said first contact between said first mating flange and said first attachment flange, said insert surrounds a closed end of said socket, and said insert surrounds said second contact between said second mating flange and said second attachment flange.

4. The shielded receptacle of claim 3 wherein:

said conductive surround further comprises at least two attachment openings, a faceplate, and a central opening interior to said faceplate;

said first contact and said second contact are accessible in said central opening; and a key hollow defined by at least one key rib extends into said central opening to create an asymmetrical circumference to said central opening.

5. The shielded receptacle of claim 4 wherein:

said conductive surround is composed of polycarbonate resin having a melting point less than 600 degrees F. and containing at least 0.8% stainless steel fibers and said insert is composed of nylon having a melting temperature greater than 600 degrees F.

6. The shielded receptacle of claim 4 wherein:

said conductive surround is composed of polycarbonate resin having a melting point less than 600 degrees F. and containing at least 0.8% stainless steel fibers and said insert is composed of polyphenylene sulfide having a melting temperature greater than 600 degrees F.

7. The shielded receptacle of claim 1 wherein:

said nonconductive material comprises a thermoplastic;

said at least 0.5% conductive additive comprises stainless steel fiber; and said insert comprises a material selected from the group consisting of nylon and polyphenylene sulfide.

8. A shielded power connection receptacle comprising:

a faceplate with at least one attachment opening and surrounding a central cavity;

a socket lock pin disposed within a socket configured to receive a locking shaft having at least one helical groove wherein said socket lock pin engages said at least one helical groove disposed on said locking shaft;

a first conductive contact disposed within said central cavity surrounded by a nonconductive thermoplastic fused to said first conductive contact, said first conductive contact having a first end extending into said central cavity and a second end extending in a second, opposite direction and positioned adjacent a shroud covering a socket closed end;

a second conductive contact disposed within said central cavity surrounded by a nonconductive thermoplastic fused to said second conductive contact, said second conductive contact having a first end extending into said central cavity and a second end extending in a second, opposite direction and positioned adjacent said shroud; and said faceplate is conductive to shield electromagnetic radiation.

9. A shielded power connection receptacle comprising:

a conductive shield, a first contact pin, a second contact pin, and a socket; and a nonconductive coating molded onto said conductive shield, said nonconductive coating connecting said first conductive pin, said second conductive pin, and said socket;

said nonconductive coating further comprises at least one exposed opening wherein said conductive shield is exposed to allow conductive connection;

said nonconductive coating forms at least one key rib;

said first contact rein is positioned within a first clearance hole in said conductive shield, said second contact pin is positioned within a second clearance hole in said conductive shield, and said socket is contacted by at least two conductive tabs to establish conductive connection with said conductive shield; and said first contact pin further comprises a first contact end within a plug opening formed in said nonconductive coating, said second contact pin further comprises a second contact end positioned within said plug opening, and said plug opening is configured to receive a plug to establish electrical connection with said first contact pin and said second contact pin.

10. The receptacle of claim 9 wherein:

said conductive shield comprises at least one conductive tab configured to retain said socket in a splayed opening prior to application of said nonconductive coating.

11. The receptacle of claim 10 wherein:

said conductive shield is composed of stainless steel.

12. The receptacle of claim 10, wherein:

said nonconductive coating is composed of molded thermoplastic.

13. The receptacle of claim 10 wherein:

said nonconductive coating is molded to form said plug opening suited to receive a plug and said nonconductive coating further comprises at least one key rib defining a key hollow to determine the orientation of said plug within said plug opening; and said nonconductive coating is noncontinuous across said conductive shield to expose a shield edge to provide conductive contact.

* * * * *